US005824370A

United States Patent [19]

Bergervoet et al.

[11] Patent Number: 5,824,370

[45] Date of Patent: Oct. 20, 1998

[54] PROCESS FOR TREATING WOOD

[75] Inventors: Anthony J. Bergervoet, Bli Bli, Australia; James L. Marcinko, Kannapolis; Paul Joseph Walcheski, Mount Ulla, both of N.C.

[73] Assignee: Chemical Specialties, Inc., Charlotte, N.C.

[21] Appl. No.: 805,503

[22] Filed: Feb. 26, 1997

Related U.S. Application Data

[63] Continuation-in-part of Ser. No. 609,087, Feb. 29, 1996, Pat. No. 5,652,023.

[51] Int. Cl.[6] ..... B05D 3/00

[52] U.S. Cl. ..... 427/297; 427/298; 427/335; 427/345; 427/381; 427/384; 427/342

[58] Field of Search ..... 427/297, 298, 427/335, 345, 381, 342

[56] References Cited

U.S. PATENT DOCUMENTS

| | | | |
|---|---|---|---|
| 4,303,705 | 12/1981 | Kelso | 427/351 |
| 4,364,976 | 12/1982 | Prokofievna et al. | 427/297 |
| 4,927,672 | 5/1990 | Prinkard | 427/336 |
| 4,942,064 | 7/1990 | Brayman et al. | 427/297 |
| 5,080,935 | 1/1992 | Kelso et al. . | |
| 5,395,656 | 3/1995 | Liang | 427/297 |

OTHER PUBLICATIONS

Zahora et al. (1993) Am Wood–Preservers' Asso. pp. 147–166.

Anderson, D.G. (1990) Am Wood Preservers' Asso. pp. 129–151.

*Primary Examiner*—Janyce Bell

*Attorney, Agent, or Firm*—Klauber & Jackson

[57] ABSTRACT

A process for treating wood involving impregnation of the wood with a preservative followed by the heat-fixation of the preservative in the wood using a pre-heated aqueous heat transfer fluid to effect the heat fixation of the preservative. The process particularly relates to steps which are taken to reduce the level of any contamination of the aqueous heat transfer fluid resulting from any wood extractives, any unfixed preservative and/or any particulate matter (i.e. "sludge") that may be present in the fluid. The contamination is preferably reduced by incorporating in the heat transfer fluid an oxidant which will preferentially oxidize any wood extractives resulting from the contact of the treated wood with the fluid without any significant reaction occurring between the oxidant and the preservative. Useful oxidants include inorganic chlorate salts such as sodium chlorate.

8 Claims, 3 Drawing Sheets

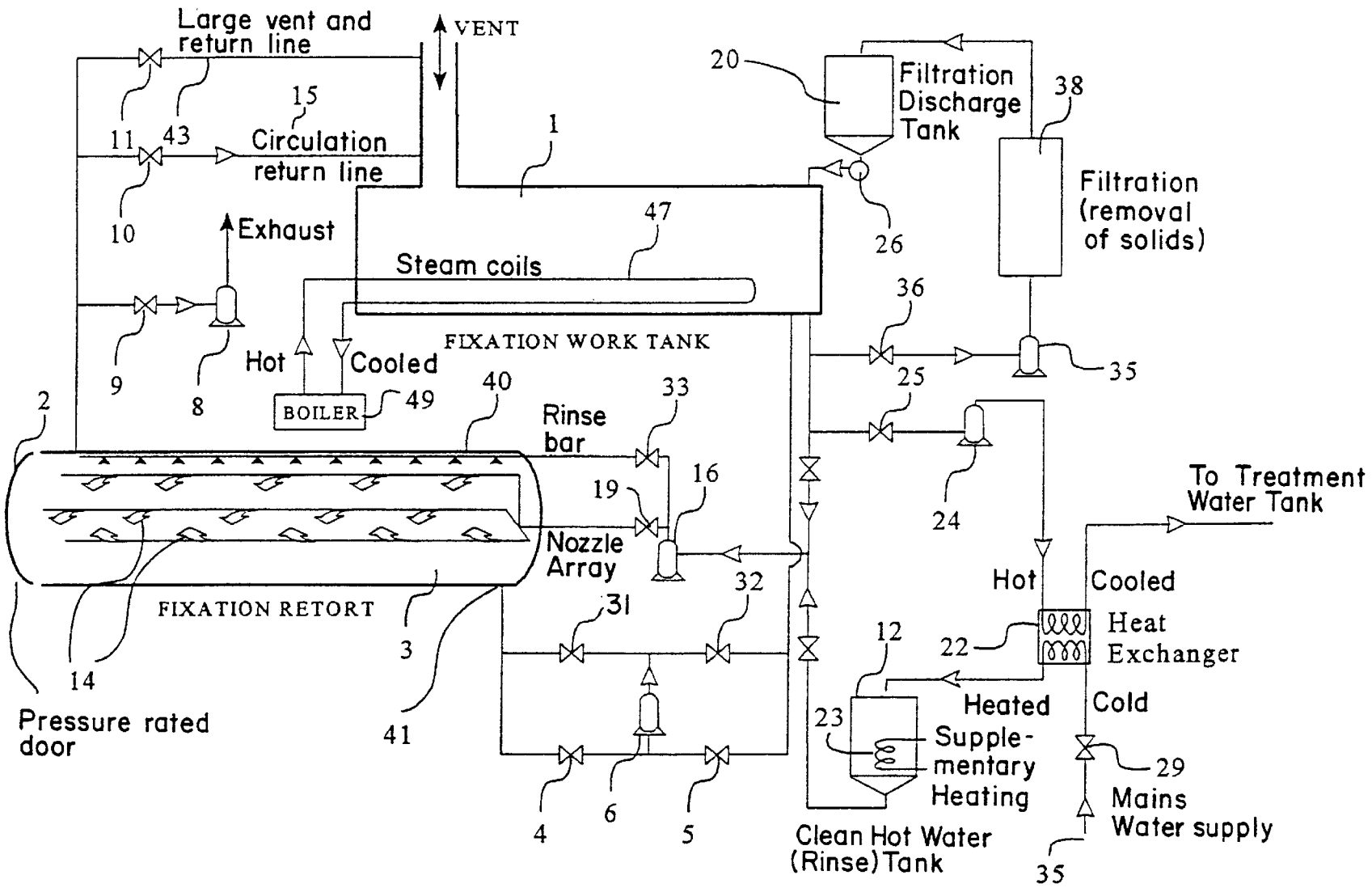
To Treatment Water Tank
Filtration (removal of solids)
Cooled
Heat Exchanger
Cold
Mains Water supply
Filtration Discharge Tank
Hot
Heated Supple-mentary Heating
Clean Hot Water (Rinse) Tank
FIXATION WORK TANK
Rinse bar
Nozzle Array
Steam coils
VENT
Large vent and return line
Circulation return line
Exhaust
Cooled
Hot
BOILER
FIXATION RETORT
Pressure rated door
FIG. 1

PROCESS FOR TREATING WOOD

REFERENCE TO RELATED APPLICATION

This application is a continuation-in-part of application Ser. No. 08/609,087, filed Feb. 29, 1996, and issued as U.S. Pat. No. 5,652,023.

FIELD OF THE INVENTION

The present invention relates to processes for treating wood with preservatives and to processes for fixing those preservatives in the wood, as well as processes which improve the wood preserving and fixing technology by increasing the consumer and environmental acceptability of the treated wood final product.

BACKGROUND OF THE INVENTION

Preservatives, especially CCA (chromated copper arsenate), CCB (chromated copper borate), ACA (ammoniacal or amine copper arsenate), and the like, have found extensive usage in wood, for the purpose of extending the useful life of the wood by their incorporation into same. Due to the highly toxic effects of these preservatives, even at very low levels, their use in the treatment of large quantities of wood, poses environmental concerns for the manufacturers. Numerous modifications of the general process of impregnating the wood with these preservatives have been developed in order to produce an economically feasible product while still meeting the environmental standards imposed upon the industry.

The principal problem in the overall process is the need to fully fix the preservative within the wood during the treatment process in order to minimize or eliminate the subsequent contamination of the area around the wood caused by the runoff of excess or non-fixed preservative. Unless the preservative is fixed within the wood, rain water will wash or leach preservative components out of the treated lumber and onto or into the soil, where they may be carried into groundwater or waterways, thus contaminating the surrounding environment.

In the process for hot water fixation of CCA-treated wood, water-insoluble materials or sludge forms in the fixation process water over a period of time due to the reaction of the CCA components utilized in the wood preservation process. This sludge is currently removed from the process by filtration in order to prevent the formation of undesirable residues on the surface of the treated wood. However, the material collected on the filter press is an undesirable hazardous waste by-product of the process that must be disposed of in an environmentally acceptable manner.

One of the main reactions contributing to the formation of sludge is the reduction of chromium from the soluble hexavalent oxidation state to the insoluble trivalent oxidation state by reaction in solution with water soluble wood components. It has been found that certain oxidants (e.g. inorganic chlorate salts) will preferentially oxidize any wood extractives resulting from the contact of the treated wood minimizes the foregoing reaction by reacting with the water-soluble wood components at a faster rate than with the hexavalent chromium. Maintaining a relatively low level of such oxidant in the fixation water results in a significant retardation of the chromium reduction reaction.

Present United States Environmental Protection Agency ("EPA") regulations define any soil or water that tests above 5.0 ppm for either arsenic or chromium as "hazardous waste", and designates the site where they are located as "contaminated". When such conditions arise, the treaters and/or their customers are required to decontaminate the site, and dispose of the "hazardous waste" at approved landfills.

The so-called "Drinkard Process" developed by William F. Drinkard, Jr. and disclosed in U.S. Pat. No. 4,927,672, used a hot-water fixation step to accelerating fixing of fixable wood preservatives in freshly impregnated wood. The process involves contacting preservative-impregnated wood with an aqueous heated liquid medium preheated to at least 38° C., raising the temperature of the wood from ambient to from 38° C. to 116° C., and maintaining both liquid contact and raised temperature of the wood for a period of time from 20 minutes up to 2 hours, whereby complete fixation occurs in less than 48 hours.

It has recently been discovered that the "Drinkard Process", while an improvement over other existing processes using steam or heated air to fix the preservatives, results in a high amount of sludge formation in the fixation medium and/or a product that is not acceptable to the consumer due to its disfigurement by the sludge chemicals.

Another process available to the wood preservative industry, but not generally used because of its practical limitations, is disclosed in U.S. Pat. No. 4,303,705. This process utilizes heating under pressure with the treating solution in order to effect fixation of the preservatives. This process, however, requires the wood to be retained within the treating vessel for the additional amount of time needed for fixation, resulting in a prolonged cycle time, and there is difficulty in maintaining pressure during removal of the treating solution and then filling with the heating medium. The objective of this process is to produce a treated wood of lower weight than the prior art methods, rather than to improve fixation. It is probable that sludging difficulties similar to those discovered with the "Drinkard Process" would also occur with the process disclosed in U.S. Pat. No. 4,303,705.

OBJECTS OF THE INVENTION

An object of the present invention is to provide an improved process for treating wood with preservatives and fixing the preservatives so as to obviate environmental concerns while still providing an economical product which meets consumer standards for product appearance, and regulatory standards for leachant contamination.

It is a further object of this invention to provide an economical product which can be produced without the need for long fixation times.

It is yet a still further object of the present invention to obviate the problems of sludge formation in the fixation medium and its subsequent deposition on the finished lumber product by preventing or slowing the sludge formation mechanism.

BRIEF DESCRIPTION OF THE DRAWINGS

FIG. 1 is a schematic diagram showing the various steps of the process of the present invention, particularly those for controlling the contamination of the aqueous heat transfer fluid by wood extractives, unfixed preservative and sludge formed by a reaction between the wood extractives and the unfixed preservative.

SUMMARY OF THE INVENTION

Figure 2:
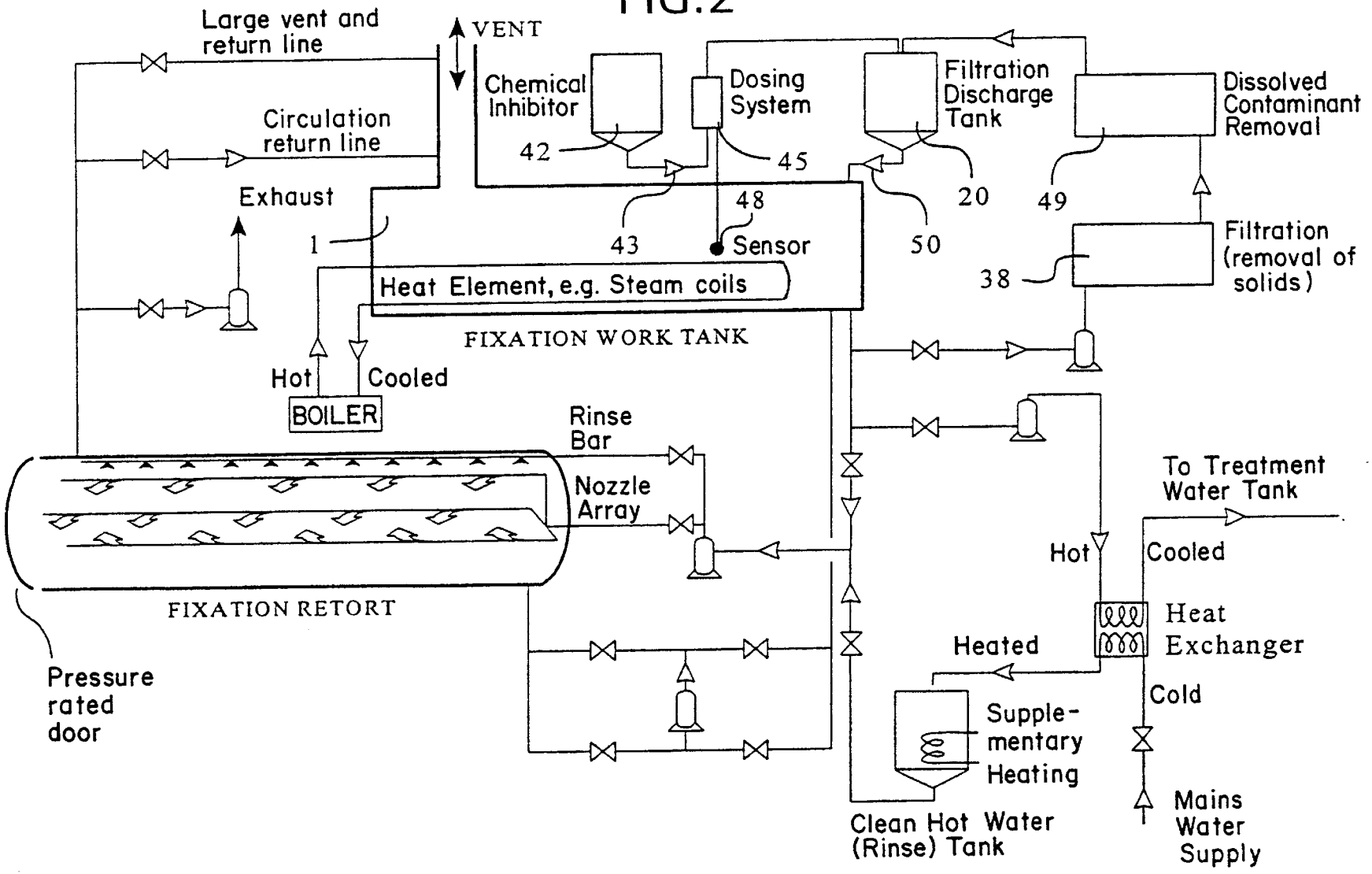
FIG. 2 is a schematic diagram of additional steps for controlling the contamination of the aqueous heat transfer fluid by wood extractives, unfixed preservative and sludge comprising the addition of chemical inhibitors to the fluid.

In accordance with the present invention there is provided an improved process for the treatment of wood preservatives in wood which comprises: (a) treating the wood with a heat-fixable preservative; (b) placing the treated wood in a fixation vessel and contacting the wood with an aqueous heat transfer fluid preheated to a temperature of at least about 55° C. and no greater than about 95° C., preferably at least about 65° C. and no greater than about 82° C.; (c) controlling the contamination of the fluid by wood extractives, unfixed preservative and particulate matter ,i.e. "sludge" on an intermittent and/or continuing basis at one or more points in the overall process; (d) maintaining contact of the fluid with the treated wood for a period of from about thirty minutes to about two hours to effect fixation of the preservative; (e) removing the fluid from the fixation vessel; (f) applying a vacuum in the range of from about 0.3 to about 0.9 atmosphere, preferably from about 0.5 to about 0.7 atmosphere for a duration of up to about 30 minutes, preferably from about 10 minutes to about 30 minutes; (g) rinsing the thus treated and fixed wood in the fixation vessel with heated clean water, heated to a temperature no greater than about 95° C., and preferably not greater than about 82° C.; and (h) releasing the vacuum, removing the rinse water from the fixation vessel, and removing the wood from the fixation vessel.

DETAILED DESCRIPTION OF THE INVENTION

The present invention relates to a process for treating wood with heat-fixable preservative materials and fixing the preservative materials in the wood. More particularly, this invention relates to a process for treating wood with heat-fixable preservatives, which comprises the following steps:

(A) placing the wood to be treated in a treatment vessel;

(B) reducing the pressure in the treatment vessel below atmospheric pressure, e.g to a pressure in the range of about 0.3–0.9 atmosphere;

(C) introducing a treatment solution comprising an aqueous medium and the preservative into the treatment vessel while maintaining the pressure in the vessel below atmospheric pressure;

(D) raising the pressure in the treatment vessel, e.g. to a level of about 1.1 to 1.5 atmospheres and impregnating the wood with the preservative;

(E) reducing the pressure in the treatment vessel to a level of about atmospheric, recovering any excess preservative in the treatment vessel and removing the treated wood from the treatment vessel;

(F) placing the treated wood resulting from step (E) in a fixation vessel;

(G) fixing the preservative in the treated wood by contacting the treated wood with an aqueous heat transfer fluid which has been pre-heated to a temperature in the range of about 55° to 95° C., preferably 65° to 82° C., for a period of time of about thirty minutes to two hours;

(H) removing from the fixation vessel the heat transfer fluid together with rinse water introduced into the fixation vessel in accordance with step (K) recited below;

(I) reducing the level of any contamination of the aqueous heat transfer fluid resulting from any wood extractives, any unfixed preservative and/or any particulate matter (i.e. "sludge") present as the result of a reaction between the wood extractives and the unfixed preservative by one or more of the following procedures, in any combination thereof:

(a) cooling the heat transfer fluid and the rinse water removed from the fixation vessel by heat exchange with clean water, thereby producing (i) cooled heat transfer fluid and rinse water which are used for preparing the treatment solution and (ii) heated clean water which is reserved for step (K);

(b) filtering the heat transfer fluid and rinse water removed from the fixation vessel to remove any particulate matter contained therein;

(c) adding to the heat transfer fluid and the rinse water removed from the fixation vessel a pH adjustment agent; and (d) establishing a pressure in the fixation vessel which will oppose movement of any wood extractives and any unfixed preservative into the heat transfer fluid and rinse water;

(J) reducing the pressure in the fixation vessel to a level of about 0.3 to 0.9 atmosphere, preferably 0.5 to 0.7 atmosphere and maintaining such reduced pressure in the fixation vessel for a period of time of about 5 to 30 minutes;

(K) introducing rinse water heated to a temperature of up to about 95° C. into the fixation vessel and rinsing the wood in the vessel; and (L) raising the pressure in the fixation vessel to about atmospheric pressure and removing the treated and fixed wood and the rinse water from the vessel.

Preferably, the aqueous heat transfer fluid will contain an oxidant which will preferentially oxidize any wood extractives resulting from the contact of the treated wood with the fluid without any significant reaction occurring between the oxidant and the preservative. Suitable oxidants are inorganic chlorate salts such as sodium chlorate (which is preferred), potassium chlorate, lithium chlorate, magnesium chlorate, cobalt chlorate, barium chlorate, copper chlorate, calcium chlorate, zinc chlorate and the like.

Desirably, the chlorate salt is sodium chlorate which is very water soluble and is best used as a solution concentrate. The sodium chlorate solution is added to the fixation water storage tank, i.e. the tank containing the aqueous heat transfer fluid, during each fixation cycle by means of a metering pump. The concentration of oxidant in the fixation water storage tank may be in the range of about 0.05 to 1.0 wt. %, preferably 0.1 to 0.3 wt. %, based on the weight of the aqueous heat transfer fluid in the tank (these concentration rates are based on the cross transfer volume) The oxidant may be added at any point in the fixation cycle, but is preferably added at the start of step (G) to ensure thorough mixing.

Preferably, the oxidant is utilized in the heat transfer fluid in conjunction with pH adjustment to further reduce the formation of precipitates in the aqueous heat transfer fluid. The pH of the fluid is desirably in the range of about 2.5 to 3.5, preferably 2.8–3.0.

The term "fixation" is used herein to describe the insolubilization of CCA (chromated copper arsenate), CCB (chromated copper borate) and ACA (ammoniacal or amine copper arsenate) wood preservatives through a series of their chemical reactions with the lignin and cellulosic components of the wood to which they are added. The functional result of these fixation reactions is to change the soluble chemicals in treating solutions to insoluble reaction products within the wood. The resulting lumber is stable to leaching and resistant to biological deterioration. The final wood product is deemed "fixed" at the time during the progression of these reactions when it complies with standard tests for assessing the degree of fixation for health and safety or environmental acceptability. As used herein, the expression "fixation performance" means any or all of product appearance, environmental performance, and health and safety performance.

The term "wood" is used in a generic or general sense herein, and is intended to cover all species of wood that may be converted to lumber which is then treated in accordance with the methods described herein. The species of wood which is used, however, will largely depend upon the region of the U.S. or a foreign country in which the saw mills and wood treatment plants are located. For example, the particular treatment and fixation regimes illustrated herein utilize conditions which are usually most suitable for Southern Yellow Pine, since the plants involved are located in the Southeastern U.S. In the Western states, on the other hand, other species of wood would be predominant, such as Douglas Fir or Ponderosa Pine, and where these were used to make treated wood, conditions would vary somewhat. For example, the aqueous heat transfer fluid used to carry out the fixation step is preheated to a temperature of at least about 55° C. and no greater than about 95° C., preferably at least about 65° C. and no greater than about 82° C. In practice, one would use as high a temperature as possible without inducing significant resin bleed in the wood, which would depend in turn on the species of wood being subjected to the fixation procedure. Fir species might be expected to withstand higher temperatures, i.e., not exhibit significant resin bleed, than pine species, especially Southern Yellow Pine, in this regard. Lower temperatures will usually protract the process and thereby increase operating costs without producing any attendant benefit. Thus, the higher temperatures are preferred.

The expression "aqueous heat transfer fluid" is intended to mean water or any aqueous solution or suspension which will not, of itself, leave a residue on or in the treated wood which is subject to leaching so as to cause environmental contamination. Such a fluid would include, e.g., an aqueous ethylene glycol solution. Chemical agents well known in the art may be added which impart some additional characteristic to the wood, e.g., pigments and dyes, fungicides, water repellents, flame retardants, and heat fixing resins.

The present invention overcomes the limitations of the prior art by utilizing modifications to the prior art methods which substantially obviate the problems of sludge formation and its concomitant deposition upon the finished lumber product, while still meeting the standards for "fixation" of the preservatives within the finished lumber, i.e., complying with standard tests for assessing the degree of fixation for health, safety and environmental acceptability, i.e. "fixation performance".

The overall process of the present invention for treating wood with heat-fixable preservatives involves placing the wood in a pressure vessel, applying an initial vacuum to the wood, introducing the aqueous heat-fixable preservative into the vessel and raising the pressure within the vessel and impregnating the wood with the heat-fixable preservative until a desired gross absorption is achieved. After applying a final vacuum to recover preservative solution from the wood and removing the wood from the pressure vessel, the preservative-treated wood is placed in a fixation vessel of suitable dimensions and the fixation vessel is filled with an aqueous heat transfer fluid preheated to a temperature of at least about 55° C. and no greater than about 95° C., preferably at least about 65° C. and no greater than about 82° C. The contamination of the heat transfer fluid by various wood extractives and unfixed preservative from the wood is controlled by one or more various means, and the wood is contacted with the heat transfer fluid for a period of thirty minutes to about two hours to effect fixation of the preservative. Then, the heat transfer fluid is removed from the fixation vessel and a vacuum in the range of from about 0.3 to about 0.9 atmosphere, preferably from about 0.5 to about 0.7 atmosphere, for a duration of up to about 30 minutes, preferably from about 10 minutes to about 30 minutes. This is followed by a rinsing of the treated and fixed wood in the fixation vessel with heated clean water, heated to a temperature of no greater than about 95° C. and preferably no greater than about 82° C. Finally, the vacuum is released, the rinse water is removed from the vessel, and then the wood is removed from the vessel.

In the prior art Drinkard process, an unrecognized and unreported thermal expansion effect has been found to result from contacting the treated, unfixed wood with the heated fixation solution. This thermal expansion of liquid and air in the wood results in the expulsion from the treated, unfixed wood of some unfixed preservative, as well as of various wood extractives. Unfixed preservative and wood extractives also enter the fixation solution through simple washing and diffusion action. These troublesome by-products are known to result in the formation of sludge within the fixation solution. This sludge is deposited upon the lumber surface during the fixation process, and results in a product which is aesthetically unappealing to the consumer due to its mottled and/or speckled appearance. If uncorrected, this deposited sludge can result in a product which does not pass the requirements for "fixation" since preservative may be removed from the wood by rainfall.

The rate of contamination of the heat transfer fluid by wood extractives and unfixed preservative chemicals, and the rate of development of sludge therefrom, is such that the process rapidly becomes unusable for a plant wherein a sustained cycle of production is necessary for economic reasons.

The present invention, surprisingly, has solved the difficulties of sludge formation by both minimizing its formation from wood extractives and unfixed preservative, as well as by removing the sludge once it has formed. By controlling the contamination of the heat transfer fluid by unfixed preservative and various extractives from the wood, sludge formation is minimized; and where sludge formation does take place, the method of the present invention has provided procedures for effectively removing it. This can be accomplished by the application of one or more steps, preferably two or more steps as hereinafter described, in any combination thereof, substantially to obviate this contamination. The expression, "substantially to obviate" as used herein, is intended to mean the prevention or reduction of sludge formation and/or the removal thereof once formed, to such an extent that it is highly probable that it will meet consumer standards for product appearance, and regulatory standards for leachant contamination or for degree of fixation in the wood.

One of the steps to control such contamination, is to establish sufficient pressure in the fixation vessel which opposes movement of the unfixed preservative from the wood into the heat transfer fluid. This applied pressure, although only moderate and neither measured nor controlled, acting on the treated wood before its contact with the fixation solution, results in substantial prevention of the thermal expansion effect, thus averting the expulsion of the preservative and wood extractives which form the sludge. The amount of pressure required for this result is generated in the course of carrying out this process step, wherein the resistance to flow to be found in an open line which carries the aqueous heat transfer fluid from the fixation vessel containing the wood to the aqueous heat transfer fluid tank. As an attribute of the process step parameters, it is not necessary to regulate this pressure.

A second method for controlling the contamination of the heat transfer fluid by the unfixed preservative from the wood is to dilute, or selectively remove the preservative from the fluid. This can be accomplished by removing the excess fluid and cooling this fluid by heat exchange with clean water, the cooled fluid being used for preparing treatment solution, and the thus-heated clean water being reserved for the rinse step. This method has obvious advantages in the overall process since it not only minimizes the sludge formation, but also reduces the total overall energy requirements for the complete process.

A third method for controlling the contamination of the aqueous heat transfer fluid by the wood extractives and unfixed preservative from the wood, i.e., the sludge, is by filtration of the fluid to remove the sludge-based particulate matter which may compromise the appearance or performance of the finished product. Such filtration may be by the use of any conventional filtering means using a variety of available materials, such that the pores thereof will trap and eliminate particulate matter in the general size range of from about 0.1 $\mu$m to about 10.0 $\mu$m, preferably from about 0.5$\mu$ to about 5.0 $\mu$m. Examples of filtration means useful in this step of the process of the present invention are a filter press precoated with fine grade diatomaceous earth or a sand bed filter charged with suitable grade sand. In any case the filtration unit must be sized appropriately to remove solids from the system at an adequate rate, i.e., with an acceptable permeability. Many other suitable filtering means will be apparent to the artisan; and it will be understood that the filtration step is not limited to a single pass through the filtration means, or even to the use of a single filtration means. It is within the scope of the present invention to pass the aqueous heat transfer fluid through the same filtration means several times, or to pass it successively through one filtration means and then through another, different, filtration means. For example, a coarse mesh filter or strainer may be employed to remove larger particles such as wood debris, dirt, or other coarse foreign matter from the fluid before it is passed through the filter press.

A fourth method for controlling the sludge formed by contamination of the aqueous heat transfer fluid by the wood extractives and unfixed preservative from the wood, is by adding to the fluid one or more members selected from the group consisting of agents for adjusting the pH of the fluid. Whether such agent or agents are chosen to lower the pH, i.e., maintain it in the acid range of about 1.0 to about 5.0, or to raise the pH, i.e., maintain it in the basic range of about 9.0 to about 13.0, will depend largely on the type of heat-fixable preservative is being used in the overall process. Preservatives such as CCA (chromated copper arsenate), CCB (chromated copper borate), ACA (ammoniacal or amine copper arsenate) all require a pH adjusting agent which will lower the pH. Accordingly, such agents will preferably be mineral and organic acids, more preferably in an amount sufficient to reduce the pH of the aqueous heat transfer fluid to from about 4.5 to about 3.5. On the other hand, there are heat-fixable preservatives which require use therewith of an agent which will raise the pH. Accordingly, such agents will be bases, preferably hydroxides of alkali metals and alkaline earth metals which will raise the pH of the fluid to from about 11.5 to about 13.0.

The reactions occurring during the formation of the sludge are possibly pH dependent, since it has been found that regular dosing of the aqueous heat transfer fluid with small amounts of sulfuric acid, introduced by way of the filtration discharge tank, and sufficient to reduce the pH thereof to about 3.5, will also reduce the rate of sludge formation by about 20%. Amounts sufficient to produce an even further reduction in pH will produce an even greater reduction in the rate of sludge formation. Accordingly, one or more members selected from the group consisting of mineral and organic acids, e.g., sulfuric acid, sulfonic acid, phosphoric acid, phosphonic acid, hydrochloric acid, nitric acid, formic acid, acetic acid, and citric acid, and soluble salt forms thereof, may be added to the aqueous heat transfer fluid in amounts sufficient to reduce the pH thereof to from about 4.5 to about 3.5. Correspondingly, one or more members selected from the group consisting of alkali bases and alkaline earth bases, e.g., sodium hydroxide, potassium hydroxide, barium hydroxide, strontium hydroxide, and calcium hydroxide, may be added to the aqueous heat transfer fluid in amounts sufficient to raise the pH thereof to from about 11.5 to about 13.0. An additional modification to the instant process involves the continuous circulation of the heated aqueous heat transfer fluid in the fixation vessel during the fixation step of the process. This is conveniently and typically accomplished by using jet nozzles to facilitate the circulation of the heated fluid into and around the packs of wood being treated. However, other devices, such as circulating pumps or stirring mechanisms, can be used to accomplish this purpose as well.

A further modification to the overall process involves the addition of a hot water rinsing of the treated fixed wood, prior to removal of the earlier applied vacuum. This has the effect of removing contaminated fixation solution and troublesome deposits, if any, from the surface of the wood. Additionally, when the vacuum is withdrawn, some of the clean water is drawn into the surface of the wood which predisposes the lumber to improved fixation performance.

Finally, in the overall process, the treated fixed wood is optionally, but desirably, removed from the fixation vessel and transferred to a system or device requiring a minimum of additional handling of the treated and fixed wood which retains the wood at ambient temperatures for an additional period of time to achieve further fixation before removal from weather protection. This may be accomplished by the use of one or more fixation bays, housed within the same building as the fixation vessel. The storage at ambient temperature within the same building takes advantage of the residual heat within the packs of treated fixed wood to further fixation before the product is exposed to the weather. Preferably, the storage time within the building is at least three hours, and preferably for as long as possible, and the bays are sloped so that the packs are tilted lengthwise, facilitating drainage and collection of drippage therefrom.

The result of these improvements in the process is an environmentally clean process, with minimal or no contamination of the environment by the preservative materials from the resultant product. A further illustration of the method of the present invention is set out below with references to the drawings. In order to prevent the description from becoming obscured with detail and hard to follow, only those valves which are open for a particular step of the process are mentioned below; those which are closed are not mentioned.

DETAILED DESCRIPTION OF THE DRAWINGS

As is schematically represented in FIG. 1, after impregnation of wood with heat-fixable preservative, it is transported on a tram or other means to fixation vessel 3. The fixation process of the present invention is carried out within fixation vessel 3 in such a way that it is accompanied by the application of sufficient pressure substantially to obviate any thermal expansion effect of the treated wood. A preferred method for applying this pressure occurs during the period of contact between the treated wood and the aqueous heat transfer fluid, and as a result of the following steps: (a) pumping aqueous heat transfer fluid from fixation work tank 1, through pump means 6 and associated valve means 5 and 31, into fixation vessel 3 in order to fill the vessel and cover the treated wood therein; (b) turning off pump means 6 and turning on pump means 16 and opening associated valve means 18 and 19 so that aqueous heat transfer fluid is introduced with agitation into fixation vessel 3 through an array of jet nozzles 14 fitted within fixation vessel 3 by means of which it is also circulated therein; (c) at the same time aqueous heat transfer fluid is being introduced with agitation into fixation vessel 3, closing valve means 11 so that the fluid cannot return to fixation work tank 1 through large vent and return line 13, while opening valve means 10 so that the fluid may return to fixation work tank 1 through circulation return line 15, whereby hydraulic throughput of the fluid from fixation vessel 3 is restricted, increasing flow resistance during circulation to effect hydraulic pressure from circulation pump 16; and (d) elevating fixation work tank outlet 21 above fixation vessel 3 during circulation to effect hydrostatic pressure. Heat energy transferred to the treated wood from aqueous heat transfer fluid being circulated in fixation vessel 3 is optionally, but preferably replenished by steam coils 47 or other heating means immersed in fixation work tank 1.

Treated wood in fixation vessel 3 continues to be contacted with circulating, agitated aqueous heated liquid medium, delivered from fixation work tank 1 through outlet 21, valve means 18 and 19, and pump means 16 to fixation vessel 3, preheated to a temperature of about 55° C. to no more than about 95° C., preferably at least about 65° C. and no greater than about 82° C. for a period of thirty minutes to about two hours. Then, the fixation solution is removed from fixation vessel 3 and returned to fixation work tank 1 by pump means 6 and associated valve means 4 and 32; after which a vacuum in the range of about 0.3 to about 0.9 atmosphere, preferably about 0.5 to about 0.7 atmosphere, is applied for a duration of up to about 30 minutes, preferably from about 10 minutes to about 30 minutes, by pump means 8 and associated valve means 9. The treated and fixed wood is then rinsed in fixation vessel 3 with heated clean water from rinse tank 12, transported by pump means 16 and associated valve means 17 and 33, heated to a temperature similar to that of the aqueous heat transfer fluid, or of about 82° C. The vacuum is then removed from the fixation vessel by opening valve means 11, allowing ambient air flowing through large vent and return line 13 to equalize the pressure. The rinse water is then removed from fixation vessel 3 by pump means 6 and associated valve means 4 and 32, and transported to fixation work tank 1, freeing the thus treated and fixed wood.

After completion of the rinse stage, one of the steps of the present invention for controlling sludge formation is carried out, in accordance with which hot aqueous heat transfer fluid is directed to one side of high efficiency heat exchanger 22 by pump means 24 and associated valve means 25 and 26; while cold water from pressurized utility main 27 is directed through valve means 29 to the other side of high efficiency heat exchanger 22. Pumping means (not shown) may be substituted for a pressurized utility main. There, most of the energy in the hot aqueous heat transfer fluid is transferred to the cold water from the main, and the thereby heated water is used to refill rinse water tank 12. Thereby, cooled aqueous heat transfer fluid is added to the treatment water supply tank (not shown) for replacing the preservative solution absorbed by the wood being treated. Residual water and aqueous heat transfer fluid in fixation vessel 3 are transported back to storage in fixation work tank 1 by pump means 6 and associated valve means 4 and 32, as soon as the vacuum has been vented by opening valve means 11, as described above.

Another step of the present invention for preventing sludge formation is carried out during the process steps described above, in accordance with which the aqueous heat transfer fluid is filtered continuously. This is accomplished by circulation of the fluid from fixation work tank 1 through pump means 35 and associated valve means 36 to filtration means 38 where particulate sludge is filtered out and removed, to filtration discharge tank 20, from which it may be added to fixation work tank 1 as needed by pump means (not shown). Yet another step of the present invention for preventing sludge formation involves applying sufficient pressure substantially to obviate a thermal expansion effect of the treated wood. This is accomplished by elevating outlet 21 of fixation work tank 1 above aqueous heat transfer fluid outlet 41 from fixation vessel 3 to fixation work tank 1 during circulation of the fluid in order to effect hydrostatic pressure; or by restriction of hydraulic throughput of the aqueous heat transfer fluid through outlet 40 from fixation vessel 3 to storage tank 1 through valve means 11, to effect hydraulic pressure from circulation pump 16, or by a combination thereof.

FIG. 2 illustrates additional aspects of the present invention relating to control of sludge formation by adding to the aqueous heat transfer fluid one or more members selected from the group consisting of mineral and organic acids. These agents are kept in chemical inhibitor tank 42, from which they are dispensed through valve means 43 to a dosing system controller 45, which relies on data, e.g., pH, input from sensor 47 in fixation work tank 1 to determine when additional agent must be added. In addition to filtration means 38 which provides for the removal of solids, there is provided dissolved contaminant removal means 49 which can remove unwanted contaminants that are dissolved in the aqueous heat transfer fluid passing through it. Relatively pure aqueous heat transfer fluid is then transported to filtration discharge tank 20, where it is available for addition through valve means 50 and pump means (not shown) to fixation work tank 1 as the need arises.

Figure 3:
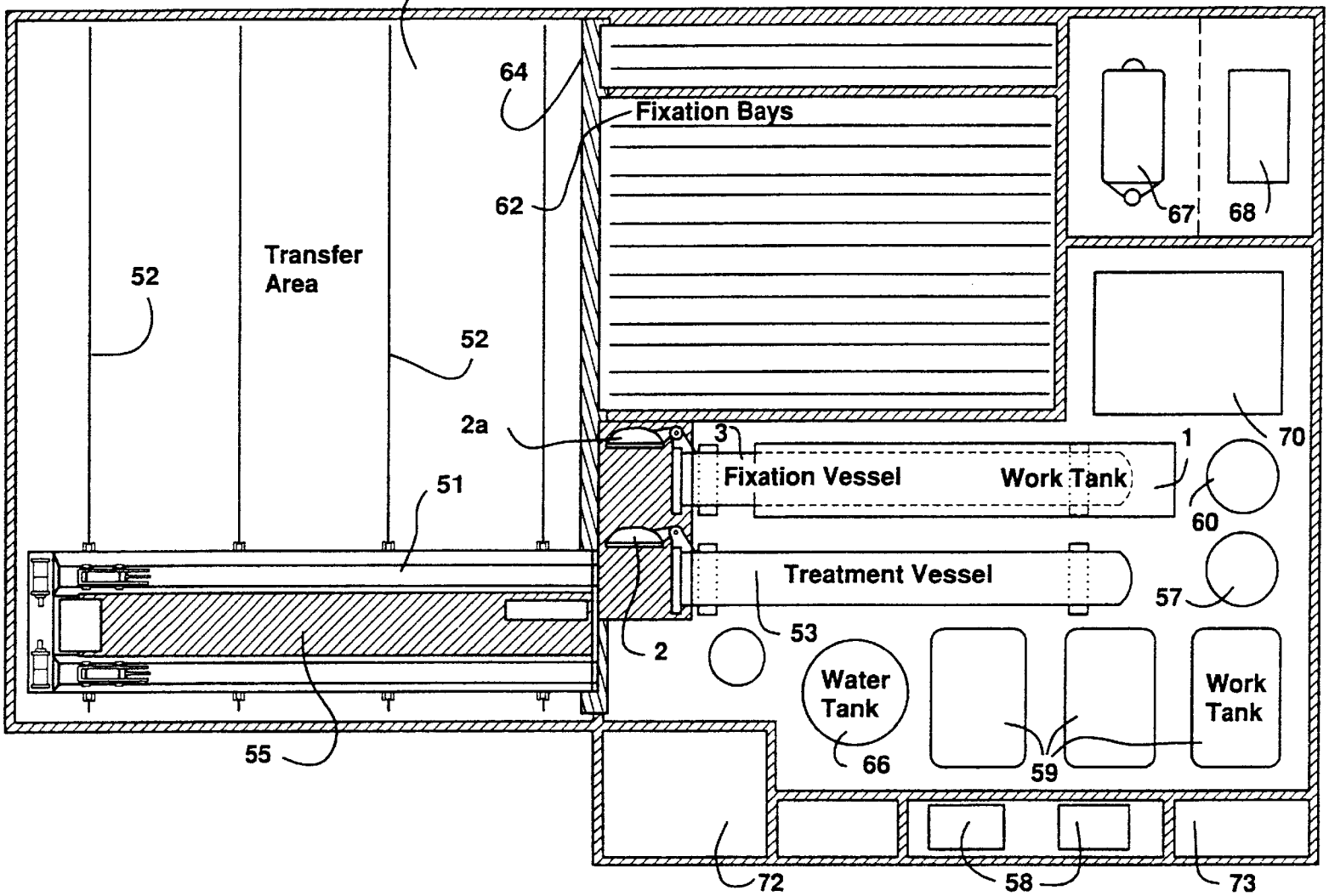
FIG. 3 is a plan view of the equipment in a typical installation for carrying out all aspects of the treatment and fixation steps of the present invention.

FIG. 3 illustrates the equipment layout and operations of a typical plant for carrying out wood treatment and fixation in accordance with the present invention. Wood to be treated is brought into the plant at point 50 where it is loaded onto transfer deck 51 which can be moved to various locations on rails 52. It has a sloped plan and hydraulic systems which permit it to manipulate the wood in the manner required at various stages. For example, transfer deck 51 first stops at treatment vessel 53 and tram 55, movably mounted on transfer deck 51, moves the wood to be treated into treatment vessel 53, after which pressure-rated door 2 is closed and sealed, allowing a vacuum to be applied to the wood inside treatment vessel 53 by means of vacuum/pressure unit 58. Heat-fixable preservative is then introduced into treatment vessel 53 from preservative supply tank 57. Pressure is applied to the wood inside treatment vessel 53 by means of a vacuum/pressure unit 58, and it is then released, after which the heat-fixable preservative is removed from treatment vessel 53 and returned to preservative supply tank 57. Preservative solution to replace those absorbed by the wood are made up in work tanks 59. Vacuum is applied again by means of vacuum/pressure unit 58 in order to remove excess preservative. The vacuum is then released and the wood is removed by tram 55 and transfer deck 51 out of treatment vessel 53 and into fixation vessel 3, after which pressure-rated door 2 is closed and sealed and fixation vessel 3 is filled with aqueous liquid heating medium from fixation work tank 1. Hot water for the aqueous liquid heating medium is supplied from hot water tank 60. After the fixation step is completed, the aqueous liquid heating medium is removed from fixation vessel 3 and returned to fixation work tank 1 and a vacuum is applied. Next, the treated and fixed wood is rinsed with hot water supplied from hot water tank 60. After the fixation step is completed, the aqueous liquid heating medium is removed from fixation vessel 3 and returned to fixation work tank 1 and a vacuum is applied. Next, the treated and fixed wood is rinsed with hot water supplied from tank 60. After the vacuum is released and the rinse water is removed from fixation vessel 3, the wood is again moved out of fixation vessel 3 by tram 55 and transfer deck 51 to fixation bays 62 where it is stacked and held at ambient temperature. Fixation bays 62 are sloped so that the packs of stored wood are tilted lengthwise, facilitating drainage and collection of drippage therefrom in catch pan 64, from which it is returned to water tank 66.

Hot water for the various applications described above is supplied by central boiler 67, with fuel supplied from fuel supply tank 68. The equipment used in the process of the present invention to control the contamination of the aqueous liquid heating medium by wood extractives and unfixed preservative known to form sludge, as well as by the sludge itself, comprising pumps, filtration means, dissolved contaminant removal means, filtration discharge tank, heat exchanger and chemical inhibitor tank and dosing system, are conveniently located together in area 70. Utility services required for the model plant described above are supplied at 72, electrical power, and 73, pressurized utility main.

The invention is illustrated further by the following Examples. Unless otherwise indicated, all parts and percentages are on a weight basis.

EXAMPLE 1

Prior to treatment, packs of unstickered, untreated wood, seasoned for treatment, are placed on a tram in the load/unload bay. Nylon straps are applied to attach the packs firmly to the tram during the entire treatment and fixation processes.

The Treatment and Impregnation Process

The tram is drawn into the transfer deck area and loaded into the treatment vessel. The impregnation solution applied from the treatment vessel is in accordance with earlier described solutions described in, for instance, U.S. Pat. No. 4,927,672, or other commercially acceptable solutions known in the art. Typically, the process of impregnation consists of applying a predetermined vacuum level and maintaining this vacuum while flooding the treating vessel with treating solution. Then, a pressure of approximately 10 atmospheres is applied until a target gross absorption of solution is obtained. Pressure is released, and the non-absorbed solution is transferred back to a storage tank. A final vacuum is applied to remove excess solution from the wood, and the volume of solution recovered from the wood during final vacuum.

During the impregnation process, compressed air is used to move the treatment solution, rather than hydraulic pumps. Consequently, some features and abilities of the so-called hydro-pneumatic plants are unique also. For example, the "combo" tank has a number of functions, one of which is to closely control the volume of solution which is forced into the wood.

The treatment process impacts one particular aspect of the thermal fixation step. Heating freshly treated wood will cause thermal expansion of liquid and air in the wood, causing at least some preservative and wood extractives to be expelled from the wood into the fixation liquid. This contamination is undesirable, and modification of the treating process, specifically the initial vacuum, to influence the degree of saturation of the wood after treatment, is one means of minimizing this contamination. Furthermore, considered application of the various steps of the treatment process as a whole will improve surface dryness of the freshly treated wood, further reducing contamination of the fixation liquid directly by dripping, washing and diffusion action, in addition to the thermal expansion effect.

The Fixation Process

The temperature at which fixation can be successfully applied is constrained by effects on product appearance. In particular, temperatures approaching and exceeding the boiling point of water cause resin mobilization. The optimum temperature range for hot water fixation is 70° to 82° C. The temperature of the aqueous heat transfer fluid is maintained at a constant level by thermostatically controlled steam coils in the aqueous heat transfer fluid storage tank. Alternatively, heat input to the fluid is reduced or avoided during idle time, which acts to minimize and/or prevent at least some sludge formation.

The tram loaded with freshly treated wood is loaded into the fixation vessel by way of the transfer deck. The vessel is closed and flooded with the hot aqueous heat transfer fluid, and aggressive circulation thereof is begun as soon as flooding is complete. This circulation is achieved by pumping the fluid from its storage tank through an array of jet nozzles fitted within the fixation vessel. Jets of fluid from these nozzles "multiply" the flow of fluid delivered from the pump by inducing the fluid present in the vessel to flow also. During this stage of the process, the aqueous heat transfer fluid forms a circuit, passing from storage tank—to pump—to nozzles—to fixation vessel, and returning to the storage tank.

The configuration of the plant is such that some pressure in the fixation vessel is generated, both from hydrostatic pressure (the storage tank is mounted above the fixation vessel) and flow resistance in the return line from the vessel to the storage tank. Thus, application of sufficient pressure to substantially obviate a thermal expansion effect of the treated wood is accomplished by (1) elevation of the aqueous heat transfer fluid storage tank outlet above the fixation vessel during circulation to effect hydrostatic pressure; and (2) restricting the hydraulic throughput of the aqueous heat transfer fluid from the fixation tank, so as to increase flow resistance during circulation to effect hydraulic pressure from the circulation pumps. This pressure is an attribute of the process step, and as such is neither deliberate or necessary, but will successfully oppose some of the thermal expansion effect described hereinabove.

Duration of the circulation stage is the primary means of controlling degree of fixation. Typically, the fixation is completed in about 30 minutes. The sufficiency of the fixation period is determined by performance of fixed packs of wood which are exposed to a simulated rainfall test, or other standard tests for assessing the degree of fixation for health and safety or environmental acceptability.

Aqueous heat transfer fluid in the fixation vessel is then pumped back to the storage tank, and a vacuum is then applied to the hot wood. Typically, this vacuum is at least 0.6 atmosphere and of about 15 minutes duration. Moisture is removed from the wood by bulk flow of liquid and by evaporation.

Prior to releasing the vacuum, a predetermined amount of hot, clean water is applied to the packs of wood from a water tank specifically dedicated to the application of the rinse water. Not only does this "rinse" displace contaminated aqueous heat transfer fluid and surface contamination from the packs of wood, but some of the clean rinse water will be drawn into the wood when the vacuum is released. The net effect is to predispose the final wood product to improved fixation performance.

After the rinse stage is completed, the vacuum is quickly released. At this point in the process, hot aqueous heat transfer fluid from a storage tank therefor and cold water from a pressurized utility main is directed to a high efficiency heat exchanger, which transfers most of the energy in the aqueous heat transfer fluid to the water from the main. The heated water from the main is used to refill the rinse water tank, while the cooled aqueous liquid transfer fluid is added to the water supply tank for replacing the preservative solution absorbed by the wood. This operation not only recovers energy from the transferred fluid, but minimizes the disastrous effect of elevated temperature on the CCA treatment solution. The rate of this cross-transfer is slowed to increase efficiency, but is scheduled so that the cross-transfer is completed before the next rinse cycle is necessary in the repetition of the entire process sequence.

The residual water in the fixation vessel is pumped back to storage as soon as the vacuum has been vented, to allow the door to be opened. The tram of fixed wood product is removed from the fixation vessel and transferred to one of a number of fixation bays, still housed within the same building. By taking advantage of residual heat within the packs to achieve further fixation before the product is exposed to the weather, a product having improved fixation performance is produced. The typical plant configuration has three fixation bays, which result in an additional thee hours of ongoing fixation before transfer to outdoor storage. These bays are sloped so that the packs are tilted lengthwise, thus facilitating drainage of liquid therefrom.

Finally, the tram is transferred from the fixation bay to the load/unload area, where the restraining straps are untied and the product is transferred to temporary yard storage to await shipment to dealers and consumers.

During the process, the aqueous heat transfer fluid is filtered continuously, during production and while the plant is idle, to remove solids which form as a result of contamination by, and interaction between wood extractives and wood preservative ingredients. If the levels of these solids, referred to herein as sludge, are not kept within limits, i.e., less than 150 ppm, they will result in a product having an unacceptable appearance.

EXAMPLE 2

Glassware Simulation

A laboratory glassware reactor was set up to model the dynamic fixation process and to evaluate the effect of addition of sodium chlorate to the fixation water. The experiment involved the removal of approximately 8% of the fixation water, replacement of such volume with fresh water and re-contamination with additional CCA and wood extractive components each fixation cycle. A 2 liter jacketed reactor was fitted with an overhead stirrer, condenser and thermocouple probe. The reactor was heated and maintained at a temperature of 77° C. by hot water from a constant temperature bath circulating through the jacket.

A batch of CCA preservative was prepared at an oxide ratio of 58.3% $CrO_3$, 29.2% $As_2O_5$ and 12.5% CuO which reflects the typical CCA contamination of the fixation water, i.e. the aqueous heat transfer fluid. A concentrate of chemical oxygen demand components (hereinafter collectively referred to as "COD") was prepared by the hot water extraction of Southern Pine wood meal.

The reactor was charged with 1,500 g of fixation water collected from a fixation plant and was allowed to heat up to the process temperature of 77° C. over a 45 minute period. A 125 ml aliquot sample was collected at this time for analysis to the reaction time=0 condition. Immediately after this sample was taken, 125 ml of a synthetic CCA/COD contamination solution was added to the reactor. The contamination solution was prepared by mixing the CCA and COD concentrates and diluting them to arrive at a target level 700 ppm $CrO_3$, 350 ppm $As_2O_5$, 150 ppm CuO and 1,800 ppm COD just prior to the addition to the reactor. Table I set forth below sets forth the results of the control runs for the fixation process simulation in respect to the reaction time, ppm of total suspended solids ("TSS"), ppm of $Cr_6^+$ (as $CrO_3$), ppm of Cu (as CuO), ppm of Cr (as $CrO_3$), ppm As as $As_2O_5$, ppm of COD and the pH.

The above procedure was repeated with a series of runs containing $NaClO_3$ which was added in the form of a 25% concentrate such that the fixation water, i.e. the aqueous heat transfer fluid would contain 0.5% $NaClO_3$. The initial dose and the last dose of the first day was double that of the others. This sequence of sample removal and fresh contamination solution addition was repeated at 1.5 hour intervals 6 times/day over two days resulting in just over 1 turnover of the reactor volume. A final sample was also taken 1.5 hours after the last sample/contamination solution addition before the reactor was emptied and cleaned for the next batch. The data for the $NaClO_3$ runs are presented in Table II below>

The data in Table II clearly demonstrate the benefit of $NaClO_3$ addition. It is seen that the TSS and COD levels decreased significantly over the reaction period as compared with the control runs shown in Table I. In addition, the hexavalent chromium content increased relative to that of the control runs indicating that the chromium reduction rate had been reduced as a consequence of the $NaClO_3$ addition.

TABLE I

Fixation Process Simulation - Control Runs

| Sample No. | Reaction Time, hr. | TSS, ppm | $Cr_6^+$, ppm | Cu, ppm | Cr, ppm | As, ppm | COD, ppm | pH |
|---|---|---|---|---|---|---|---|---|
| 1 | 0.0 | 188.8 | 216.1 | 34.0 | 305.1 | 35.9 | 1620 | 4.32 |
| 2 | 1.5 | 231.6 | 231.5 | 41.5 | 310.6 | 42.3 | 1600 | 4.12 |
| 3 | 3.0 | 266.0 | 234.6 | 48.3 | 323.2 | 53.3 | 1620 | 4.02 |
| 4 | 4.5 | 293.7 | 253.8 | 55.0 | 338.3 | 62.6 | 1600 | 3.94 |
| 5 | 6.0 | 320.5 | 282.3 | 60.6 | 347.6 | 71.9 | 1600 | 3.88 |
| 6 | 7.5 | 339.3 | 288.8 | 67.5 | 372.8 | 80.5 | 1600 | 3.89 |
| 7 | 9.0 | 336.9 | 299.2 | 71.0 | 380.2 | 86.1 | 1600 | 3.79 |
| 8 | 23.25 | 535.6 | 256.9 | 63.5 | 300.2 | 28.6 | 1480 | 3.94 |
| 9 | 24.75 | 521.9 | 280.0 | 69.7 | 319.2 | 46.0 | 1460 | 3.87 |

TABLE I-continued

| Fixation Process Simulation - Control Runs | | | | | | | | |
|---|---|---|---|---|---|---|---|---|
| Sample No. | Reaction Time, hr. | TSS, ppm | $Cr_6^+$, ppm | Cu, ppm | Cr, ppm | As, ppm | COD, ppm | pH |
| 10 | 26.75 | 530.8 | 273.5 | 74.3 | 327.4 | 53.7 | 1440 | 3.88 |
| 11 | 27.75 | 495.2 | 288.5 | 81.9 | 354.0 | 72.3 | 1480 | 3.80 |
| 12 | 29.25 | 500.3 | 292.3 | 84.2 | 358.9 | 76.0 | 1520 | 3.77 |
| 13 | 30.75 | 476.6 | 298.8 | 89.3 | 373.3 | 82.8 | 1420 | 3.72 |
| 14 | 32.25 | 505.1 | 311.9 | 92.0 | 382.2 | 85.9 | 1420 | 3.67 |

TABLE II

| Fixation Process Simulation - 0.5% $NaClO_3$ (applied as a 25% concentrate) | | | | | | | | | |
|---|---|---|---|---|---|---|---|---|---|
| Sample No. | Reaction Time, hr. | $NaClO_3$ Dose, g | TSS, ppm | $Cr_6^+$, ppm | Cu, ppm | Cr, ppm | AS, ppm | COD, ppm | pH |
| 15 | 0.0 | 5.0 | 241.9 | 213.8 | 33.4 | 299.4 | 36.5 | 1600 | 4.28 |
| 16 | 1.5 | 2.5 | 262.8 | 240.4 | 42.6 | 311.9 | 46.0 | 1380 | 4.11 |
| 17 | 3.0 | 2.5 | 264.5 | 274.2 | 52.0 | 344.8 | 64.8 | 1320 | 4.11 |
| 18 | 4.5 | 2.5 | 256.0 | 300.0 | 59.4 | 364.8 | 82.7 | 1200 | 3.79 |
| 19 | 6.0 | 2.5 | 250.0 | 330.4 | 69.0 | 401.0 | 103.6 | 1180 | 3.65 |
| 20 | 7.5 | 2.5 | 212.9 | 343.8 | 76.2 | 424.3 | 121.4 | 1140 | 3.56 |
| 21 | 9.0 | 5.0 | 225.7 | 366.5 | 84.3 | 447.4 | 140.3 | 1060 | 3.45 |
| 22 | 23.25 | 2.5 | 247.3 | 351.9 | 89.8 | 453.0 | 137.6 | 1000 | 3.37 |
| 23 | 24.75 | 2.5 | 228.3 | 377.7 | 95.8 | 474.7 | 154.8 | 940 | 3.28 |
| 24 | 26.25 | 2.5 | 212.9 | 412.6 | 100.7 | 479.8 | 169.0 | 980 | 3.19 |
| 25 | 27.75 | 2.5 | 193.8 | 439.5 | 103.6 | 492.0 | 177.3 | 860 | 3.11 |
| 26 | 29.25 | 2.5 | 176.8 | 452.2 | 108.2 | 526.8 | 195.0 | 860 | 3.09 |
| 27 | 30.75 | 2.5 | 179.1 | 472.0 | 111.6 | 522.1 | 203.1 | 840 | 3.04 |
| 28 | 32.25 | — | 152.6 | 480.2 | 114.8 | 544.9 | 214.1 | 820 | 2.99 |

EXAMPLE 2

Pilot Plant Run

A tote of fixation water was obtained from a fixation plant and used as the starting fixation water solution in the pilot plant trials. The fixation pilot plant consisted of a fixation retort vessel, heated fixation water storage tank and a heated fresh water tank. The trials were run without any filtration.

A bundle of 15 Southern Pine boards (61×122×10 cm) were treated with CCA to a target retention value of 0.0064 $g/cm_3$ in each treatment charge. After each charge, the treated lumber was then transferred to the fixation retort. The retort was flooded with fixation water (77° C.) and circulated through the retort to the storage tank and back to the retort for 20 minutes. Thereafter, the fixation solution was removed from the retort and transferred back to the storage tank. The retort was then placed under vacuum, reaching a maximum vacuum of about 0.7 atm. over 20 minutes. While under vacuum, fresh hot water was sprayed over the bundle. The vacuum was released and the wood removed. Thereafter, this wash liquid was transferred back to the storage tank, the isolution was mixed and the solution volume was reduced to the starting level.

The first series of treatment and fixation charges was a control run which included a sulfuric acid addition to the work tank to a target pH of 3.5. Five charges were run each of two days. The fixation work solution was sampled at the beginning of the fixation circulation step in each charge for analysis. The results obtained in the control runs are set forth in Table III below.

After the control runs had been completed, the fixation water was removed from the system and replaced with fresh material for the $NaClO_3$ trials. Sodium chlorate was added to the storage tank as a 25% solution using a metering pump. The pH was adjusted to a target range of 2.8–30 by adding sulfuric acid to the storage tank. The reagents were added during the circulation step after the samples were taken in the fixation cycle. In addition, an initial dose of sodium chlorate solution was added at the beginning of the trial and a dose was added after the last charge of each day. The chlorate dosages started out at a relatively high level and were reduced to 0.28% based on the wash volume. The results obtained in the $NaClO_3$ runs are set forth in Table IV below.

Referring to Table III, it is seen that the fixation water employed in the control runs showed a steady drop in the soluble chromium and arsenic values during the first day, then a large decrease overnight. The COD content gradually decreased while the TSS content was high and variable throughout the runs. Surface residues on the wood were obvious after fixation.

Referring to Table IV, the sodium chlorate runs show a much more rapid decrease in the COD content of the fixation water than that reflected in the control runs. Furthermore, the data in Table IV indicate that the a soluble metals were maintained at much higher levels with a lesser drop in concentration during the overnight intervals than the drop in concentration shown in Table III. Whereas, the COD level dropped to approximately 1400 ppm during the control runs, the COD level decreased to approximately 500 ppm by the end of the sodium chlorate trials and the level of suspended solids steadily decreased throughout the sodium chlorate trials. This example demonstrates the benefit of having an oxidant present in the fixation water, i.e. the aqueous heat exchange fluid.

TABLE III

| Pilot Plant Trials - Control Runs | | | | | | | | |
|---|---|---|---|---|---|---|---|---|
| Charge | Day | TSS, ppm | $Cr_6^+$, ppm | Cu, ppm | Cr, ppm | As, ppm | COD | pH |
| Tote Sample | 0 | 211.6 | 402.4 | 80.7 | 482.0 | 131.8 | 1900 | 3.76 |
| 4 | 1 | 381.6 | 234.7 | 68.6 | 365.1 | 50.4 | 1800 | 3.68 |
| 5 | 1 | 291.1 | 314.1 | 64.3 | 362.3 | 52.6 | 1760 | 3.85 |
| 6 | 1 | 338.1 | 289.2 | 62.5 | 327.6 | 41.7 | 1620 | 3.62 |
| 7 | 1 | 312.7 | 269.2 | 64.0 | 319.6 | 43.3 | 1590 | 3.42 |
| 8 | 1 | 300.4 | 261.8 | 62.5 | 319.4 | 42.8 | 1540 | 3.59 |
| 9 | 2 | 475.6 | 108.3 | 60.5 | 172.0 | 5.8 | 1440 | 3.51 |
| 10 | 2 | 285.4 | 122.8 | 57.1 | 179.3 | 11.5 | 1400 | 3.59 |
| 11 | 2 | 285.9 | 113.2 | 58.0 | 169.1 | 9.4 | 1420 | 3.56 |
| 12 | 2 | 460.5 | 120.6 | 58.4 | 178.3 | 15.3 | 1420 | 3.62 |
| 13 | 2 | 429.2 | 125.7 | 60.5 | 186.5 | 18.6 | 1340 | 3.27 |
| Final Work Tank | 2 | 385.5 | 117.6 | 59.0 | 186.4 | 19.5 | 1390 | 3.38 |

TABLE IV

| Pilot Plant Trials - $NaClO_3$ Runs | | | | | | | | |
|---|---|---|---|---|---|---|---|---|
| Charge | Day | TSS, ppm | $Cr_6^+$, ppm | Cu, ppm | Cr, ppm | As, ppm | COD | pH |
| Initial Work Tank | 0 | 408.5 | 374.2 | 69.8 | 415.0 | 80.8 | 1900 | 3.80 |
| 14 | 1 | 386.6 | 420.0 | 80.0 | 415.7 | 79.6 | 1660 | 3.17 |
| 15 | 1 | 392.3 | 404.6 | 80.1 | 406.5 | 66.2 | 1460 | 3.03 |
| 16 | 1 | 378.5 | 389.2 | 81.0 | 407.6 | 69.7 | 1280 | 3.02 |
| 17 | 1 | 323.8 | 385.4 | 82.8 | 408.7 | 74.7 | 1140 | 3.86 |
| 18 | 1 | 261.8 | 360.0 | 82.3 | 394.5 | 68.6 | 990 | 2.84 |
| Work tank | 2 | 336.1 | 257.9 | 78.8 | 352.4 | 47.5 | 840 | 2.86 |

TABLE IV-continued

| Pilot Plant Trials - $NaClO_3$ Runs | | | | | | | | |
|---|---|---|---|---|---|---|---|---|
| Charge | Day | TSS, ppm | $Cr_6^+$, ppm | Cu, ppm | Cr, ppm | As, ppm | COD | pH |
| pre-charge | | | | | | | | |
| 19 | 2 | 157.9 | 278.7 | 80.9 | 353.2 | 42.8 | 800 | 2.85 |
| 20 | 2 | 299.2 | 278.3 | 79.4 | 360.4 | 48.3 | 840 | 2.91 |
| 21 | 2 | 274.7 | 281.3 | 78.4 | 360.5 | 52.9 | 820 | 2.83 |
| 22 | 2 | 231.2 | 254.8 | 71.3 | 330.4 | 53.1 | 730 | 2.97 |
| 23 | 2 | 215.3 | 264.1 | 68.7 | 331.0 | 54.5 | 720 | 2.85 |
| Work tank | 8 | 282.0 | 180.3 | 65.0 | 263.7 | 13.3 | 720 | 2.79 |
| pre-charge | | | | | | | | |
| 24 | 8 | 269.2 | 197.1 | 65.8 | 261.1 | 14.9 | 680 | 2.86 |
| 25 | 8 | 248.4 | 204.3 | 67.0 | 271.4 | 21.5 | 640 | 2.93 |
| 26 | 8 | 228.0 | 228.7 | 67.9 | 280.4 | 27.2 | 610 | 2.91 |
| 27 | 8 | 204.6 | 233.8 | 69.1 | 294.8 | 34.5 | 580 | 2.97 |
| 28 | 8 | 184.6 | 263.3 | 68.8 | 303.6 | 42.7 | 400 | 2.97 |
| Work tank | 9 | 183.5 | 234.7 | 70.4 | 289.4 | 35.2 | 340 | 2.79 |
| pre-charge | | | | | | | | |
| 29 | 9 | 196.1 | 220.7 | 69.6 | 286.8 | 31.5 | 490 | 2.86 |
| 30 | 9 | 182.7 | 242.9 | 70.0 | 295.4 | 35.9 | 480 | 2.93 |
| 31 | 9 | 169.6 | 249.8 | 69.8 | 304.6 | 40.8 | 440 | 2.91 |
| 32 | 9 | 160.0 | 264.4 | 69.8 | 303.7 | 42.9 | 470 | 2.97 |
| 33 | 9 | 152.6 | 260.3 | 69.1 | 304.3 | 47.5 | 460 | 2.97 |
| Work tank | 12 | 107.7 | 229.0 | 68.0 | 282.1 | 27.1 | 410 | 3.03 |
| pre-charge | | | | | | | | |
| 34 | 12 | 171.1 | 211.5 | 69.4 | 285.2 | 27.4 | 430 | 2.85 |
| 35 | 12 | 155.1 | 242.7 | 70.3 | 292.7 | 34.4 | 415 | 2.94 |
| 36 | 12 | 154.7 | 244.4 | 71.1 | 298.1 | 39.8 | 450 | 2.98 |
| 37 | 12 | 143.3 | 258.8 | 73.1 | 307.0 | 43.3 | 440 | 2.92 |
| 38 | 12 | 38.2 | 271.9 | 72.9 | 326.4 | 50.3 | 485 | 2.99 |
| Work tank | 13 | 145.5 | 279.9 | 71.4 | 316.5 | 42.4 | 490 | 2.90 |
| pre-charge | | | | | | | | |
| 39 | 13 | 142.7 | 256.6 | 72.2 | 314.8 | 42.8 | 470 | 2.92 |
| 40 | 13 | 139.3 | 272.9 | 74.1 | 326.4 | 46.0 | 510 | 2.99 |
| 41 | 13 | 119.0 | 253.7 | 69.0 | 307.3 | 46.6 | 470 | 2.98 |
| 42 | 13 | 119.4 | 267.9 | 71.8 | 329.7 | 51.5 | 480 | 2.86 |
| 43 | 13 | 111.0 | 281.4 | 71.6 | 331.0 | 53.5 | 490 | 2.90 |
| Final work solution | 13 | 107.6 | 286.6 | 72.9 | 341.7 | 58.3 | 500 | 3.05 |

What is claimed is:

1. A process for treating wood with a heat-fixable preservative which comprises the steps of:

(A) placing the wood to be treated in a treatment vessel;

(B) applying a vacuum to the treatment vessel to thereby reduce the pressure in a treatment vessel below atmospheric pressure;

(C) introducing a treatment solution comprising an aqueous medium and the preservative into the treatment vessel while maintaining the pressure in the vessel below atmospheric pressure;

(D) raising the pressure in the treatment vessel to a level above atmospheric pressure and impregnating the wood with the preservative;

(E) reducing the pressure in the treatment vessel to a level of about atmospheric pressure, recovering any excess preservative in the treatment vessel and removing the treated wood from the treatment vessel;

(F) placing the treated wood resulting from step (e) in a fixation vessel;

(G) fixing the preservative in the treated wood by contacting the treated wood with an aqueous heat transfer fluid which has been pre-heated to a temperature of about 55° to 95° C. for a period of time of about thirty minutes to two hours, said fluid containing an oxidant comprising an inorganic chlorate salt which will oxidize any wood extractives resulting from such contact without any significant reaction occurring between the oxidant and the preservative;

(H) removing from the fixation vessel the heat transfer fluid together with rinse water heated to a temperature of up to about 95° C. which has been introduced into the fixation vessel as recited in step (K);

(I) reducing the level of any contamination of the aqueous heat transfer fluid resulting from any wood extractives, any unfixed preservative and/or any particulate matter present in the fluid by one or more of the following procedures, in any combination thereof:

(a) cooling the heat transfer fluid and the rinse water removed from the fixation vessel by heat exchange with clean water, thereby producing (i) cooled heat transfer fluid and rinse water which are used for preparing the treatment solution and (ii) heated clean water which is reserved for step (K);

(b) filtering the heat transfer fluid and rinse water removed from the fixation vessel to remove any particulate matter contained therein;

(c) adding to the heat transfer fluid and the rinse water removed from the fixation vessel a pH adjustment agent; and (d) establishing a pressure in the fixation vessel which will oppose movement of any wood extractives and any unfixed preservative into the heat transfer fluid and rinse water;

(J) reducing the pressure in the fixation vessel to a level of about 0.3 to 0.9 atmosphere and maintaining such reduced pressure in the fixation vessel for a period of time of about 5 to 30 minutes;

(K) introducing rinse water heated to a temperature of up to about 95° C. into the fixation vessel and rinsing the treated and fixed wood in the vessel; and (L) raising the pressure in the fixation vessel to about atmospheric pressure and removing the treated and fixed wood and the rinse water from the vessel.

2. A method according to claim 1 wherein the filtering in sub-step (b) of step (I) is accomplished using a filter press precoated with a fine grade of diatomaceous earth, or a sand bed filter.

3. A method according to claim 1 wherein the salt comprises sodium chlorate.

4. A method according to claim 3 wherein the sodium chlorate is present in the heat transfer fluid in a concentration in the range of about 0.05 to 1.0 wt. %.

5. A method according to claim 1 wherein the heat transfer fluid in step (G) is pre-heated to a temperature of about 65° to 85° C., the reduced pressure in step (C) is maintained in the range of about 0.5 to 0.7 atmosphere for a period of time of about ten to thirty minutes and the rinse water in step (K) is heated to a temperature of up to about 82° C.

6. A method according to claim 1 wherein the heat transfer fluid is continuously circulated in and through the fixation vessel during step (G).

7. A method according to claim 1, further comprising maintaining the treated and fixed wood in fixation bays, after removal from the fixation vessel, for a period of at least about three hours before exposure of the treated and fixed wood to the outside environment.

8. A method according to claim 1 wherein the heat transfer fluid and the rinse water which have been removed from the fixation vessel are directed to a heat exchanger so as to transfer heat from the fluid and the rinse water to incoming cold water from a utility main which is then reserved for step (K).

* * * * *